US006342083B1

(12) United States Patent
Spitzer

(10) Patent No.: US 6,342,083 B1
(45) Date of Patent: Jan. 29, 2002

(54) FILTER DEVICE FOR A CHEESE-PRODUCING TEXTILE MACHINE

(75) Inventor: Michael Spitzer, Korschenbroich (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/491,765

(22) Filed: Jan. 26, 2000

(30) Foreign Application Priority Data

Feb. 26, 1999 (DE) ..... 199 08 377

(51) Int. Cl.[7] ..... B01D 46/46; D01B 3/00

(52) U.S. Cl. ..... 55/283; 55/284; 55/312; 55/467; 55/482; 19/200; 19/205

(58) Field of Search ..... 55/283, 284, 467, 55/472, 312, 482, 488; 19/200, 205

(56) References Cited

U.S. PATENT DOCUMENTS

| | | | | |
|---|---|---|---|---|
| 3,762,143 A | * | 10/1973 | Stewart | 55/283 |
| 3,887,341 A | * | 6/1975 | Sutter | 55/467 |
| 4,778,491 A | * | 10/1988 | Yow, Sr. | 55/283 |

FOREIGN PATENT DOCUMENTS

| | | |
|---|---|---|
| DE | 20 28 410 | 4/1975 |
| DE | 26 44 274 A1 | 4/1977 |
| DE | 30 10 011 A1 | 9/1981 |
| DE | 30 17 838 A1 | 11/1981 |
| DE | G8811959.9 | 12/1988 |
| DE | 39 00 543 A1 | 7/1990 |

* cited by examiner

*Primary Examiner*—Robert A. Hopkins
(74) *Attorney, Agent, or Firm*—Kennedy Covington Lobdell & Hickman, LLP

(57) ABSTRACT

A filter device (4) for a cheese-producing textile machine (1) having a plurality of pneumatic devices, e.g., open-end spinning devices (2), service units (3), etc. The filter device (4) has negative pressure filter chambers (6, 6'), each divided via a closure mechanism (9, 9') into a main filter chamber (7, 7') and a reserve filter chamber (8, 8'), and an intermediate chamber (14), to which a negative pressure source (5) is connected. Closable suction openings (12, 12') and (13, 13') in the main and reserve filter chambers, respectively, are connected with the intermediate chamber. The suction openings (12, 12') and (13, 13') are equipped with respective closure elements (15, 16) and (15', 16') which are functionally coupled such that, upon closure of one suction opening (12 or 12'), the other suction opening (13 or 13') is automatically opened.

13 Claims, 2 Drawing Sheets

R
5
17
17'
10
10'
14
12
12'
13
13'
15
15'
16
16'
7
7'
8
8'
11
11'
6
6'
22
22'
24
24'
9
9'
23
23'
25
26
26,27
27
4
1
2
3
18
19
20
21
28

FILTER DEVICE FOR A CHEESE-PRODUCING TEXTILE MACHINE

FIELD OF THE INVENTION

The present invention relates to a filter device as generically defined by the preamble to claim 1.

BACKGROUND OF THE INVENTION

Textile machines, especially those operating by the so-called open-end spinning process, have many pneumatically operated devices and systems and therefore as a rule have a negative pressure system as a part of the machine itself that furnishes the negative pressure required for the spinning process at the open-end spinning units.

Such negative pressure systems essentially comprise a negative pressure source, such as a suction fan, a filter device upstream thereof, and a suction conduit extending the length of the machine, to which the individual open-end spinning units are connected via branch lines.

In many of the known open-end rotary spinning machines, a transverse suction duct is often also connected to the filter device, for pneumatically supplying a service unit, e.g., a vacuuming device for cleaning the dirt conveyor belts of a mechanical dirt disposal device located below the spinning units.

The filter device has at least one filter chamber. Located inside the filter chamber, usually crosswise to the flow of suction, is a filter element, for filtering the aspirated air which typically is contaminated with dirt particles and fibers. Thus, the filter element traps the dirt particles and fibers in the filter chamber.

However, a disadvantage of these known devices is that the filter element becomes clogged by the aspirated particles after only a relatively short time, which leads to a marked pressure drop in the negative pressure system of the textile machine. In turn, since open-end spinning machines always require a minimum negative pressure for the production process, the filter elements in the known devices must be cleaned at relatively short intervals.

For this reason, it has already been proposed to equip filter devices with two filter chambers that can be acted upon separately. In these filter devices, known for instance from German Patent Disclosure DE 30 10 011 A1, one of the filter chambers at a time is acted upon by negative pressure, while at the same time the filter element of the other filter chamber can be cleaned. In this known device, a plurality of incoming air flaps, shutoff flaps, and diversion flaps are provided for deflecting the air flows inside the filter device, and are coupled together via a lever linkage and triggered by means of a pneumatic cylinder. Because of its quite complicated flap control among other things, this known device requires a relatively large amount of space.

A comparable filter device that is somewhat more compact and is markedly simpler in design in its arrangement of the diversion flaps is known from German Patent Disclosure DE 26 44 274 A1. A disadvantage of this device, however, is the relatively short intervals required between cleanings.

To lengthen the cleaning intervals, it has also been proposed (e.g., German Patent Disclosure DE 39 00 543 A1) that a fine-pore filter medium be employed, which is multiple times larger than the active filter surface area. The filter medium is arranged in the filter chamber in a manner enabling it to be shifted from a readiness position to an active filter position and therefrom, after being exhausted by becoming soiled, can be shifted to a disposal position. The replacement of the filter medium can be done automatically by means of a feeding system as a function of the degree of soiling, which is ascertained by a soiling sensor. However, even this known device has not been established in practice.

For lengthening the cleaning intervals, it is also known to dispose a filter element in a filter chamber in a manner such that the filter element is at least partially self- cleaning. One such filter chamber is described for instance in German Patent Disclosure DE 198 36 065.7, published after the filing date of the present application. The negative pressure system of the textile machine has a filter chamber with two screen elements disposed in an L-shape. One of the screen elements is operative as a relief screen and is spaced apart in the filter chamber from the side wall of the filter chamber in such a way that a flow of suction occurring between the suction conduit connection and the connection for the negative pressure source extends virtually parallel to this relief screen. A second screen element, spaced apart from the filter chamber bottom, is operative as a collector screen and is positioned approximately orthogonally to the flow of suction.

This disposition of the filter screens inside the filter chamber assures that the predominantly very fine dirt and fiber particles that reach the filter chamber via the suction conduit connection are deposited immediately and remain on the collecting screen. The relief screen, over which the flow of suction initially sweeps virtually parallel, remains maximally free of dirt particles for an extended time. Thus, this previously described filter device can achieve cleaning intervals of a length previously unknown.

SUMMARY OF THE INVENTION

In view of the above-described prior art, it is an object of the present invention to provide a filter device which, on the one hand, has extended cleaning intervals and, on the other hand, can be cleaned as needed without impairing regular ongoing spinning operation or causing other problems.

This object is attained according to the present invention by a filter device for a suction system of a cheese-producing textile machine which basically comprises at least one filter chamber, an intermediate chamber connected to the filter chamber, and a negative pressure source connected to the intermediate chamber. Preferably, the filter device has two filter chambers with the intermediate chamber therebetween and at least one of the filter chambers is sub-divided into a main filter sub-chamber and a reserve filter sub-chamber. According to the present invention, a closure mechanism is associated with the intermediate chamber for selectively communicating the negative pressure source with the filter chambers. The closure mechanism includes suction openings for communicating the intermediate chamber with the main filter sub-chamber and the reserve filter sub-chamber and closure elements respectively associated with the suction openings and functionally coupled with one another for closing and opening the suction openings alternately. In this manner, the intermediate chamber communicates alternately with the main filter sub-chamber and the reserve filter sub-chamber.

The present invention thusly combines the advantages of the filter devices known from the prior art, yet without having their disadvantages. That is, the filter device of the invention is distinguished not only by a compact structure and long cleaning intervals but also, as needed, by good accessibility of the filter elements to be cleaned. In addition, during the cleaning of the filter elements, both regular spinning operation and the supply of negative pressure to the surface unit remain maximally unaffected. Maintaining the negative pressure level even while the filter is being cleaned has a favorable effect on the utility of the service unit in the region of the transverse suction duct and thus in the final analysis on the total efficiency of the open-end spinning machine as well.

A preferred embodiment of the invention provides the advantageous feature of mechanically coupling the closure elements for the suction openings of the main filter chambers with the closure elements for the suction openings of the reserve filter chambers. This kind of mechanical coupling arrangement enables not only a defined opening and closing of these suction openings but also furnishes a very sturdy and thus long-lived device, which can moreover be produced economically.

Since the main filter chambers, before their cleaning doors are opened, must be maximally free of negative pressure, it is also provided, that one pressure equalization opening is disposed in the region of each of the main filter chambers. The pressure equalization opening is automatically opened upon closure of the suction openings of the main filter chambers. In this manner, it is assured that the negative pressure in the main filter chamber drops far enough that the cleaning door can be removed without problems. Preferably, the cleaning door is mounted to be openable from outside the filter device which facilitates manual cleaning if desired.

The preferred embodiment also has a closure disposed between the main filter chamber and the reserve filter chamber and the cleaning door includes a mechanism connected with the closure for closing the closure when the cleaning door is opened. More specifically, a lever disposed on the closing mechanism engages a pivotably disposed flap from behind and lifts it onto a frame disposed between the filter chambers. Under the influence of the negative pressure prevailing in the reserve filter chamber, the flap remains on this frame even after the cleaning door has been removed and thus partitions off the main filter chamber from the reserve filter chamber.

In the preferred embodiment, the filter device has two substantially identical filter chambers, which are preferably disposed symmetrically with respect to the longitudinal center axis of the machine and in mirror-image to one another.

One of the filter chambers communicates with a suction conduit which extends the length of the machine and to which the numerous open-end spinning devices are connected. The generous dimensioning of the suction conduit assures that an adequate and approximately constant negative pressure will always be applied to all the open-end spinning devices, which is indispensable if optimal spinning is to be obtained.

The other filter chamber communicates with vacuuming devices for the dirt conveyor belts and with transverse suction ducts by which negative pressure required by the service units is furnished. By separating the individual flows of suction, a drop in negative pressure, as can happen in operation of the service unit, is prevented from adversely affecting the negative spinning pressure required at the open-end spinning devices.

Further features, details and advantages of the present invention will be recognized and understood from an exemplary embodiment described below in conjunction with the accompanying drawings.

DESCRIPTION OF THE PREFERRED EMBODIMENT

Figures 1, 1A, 1B:
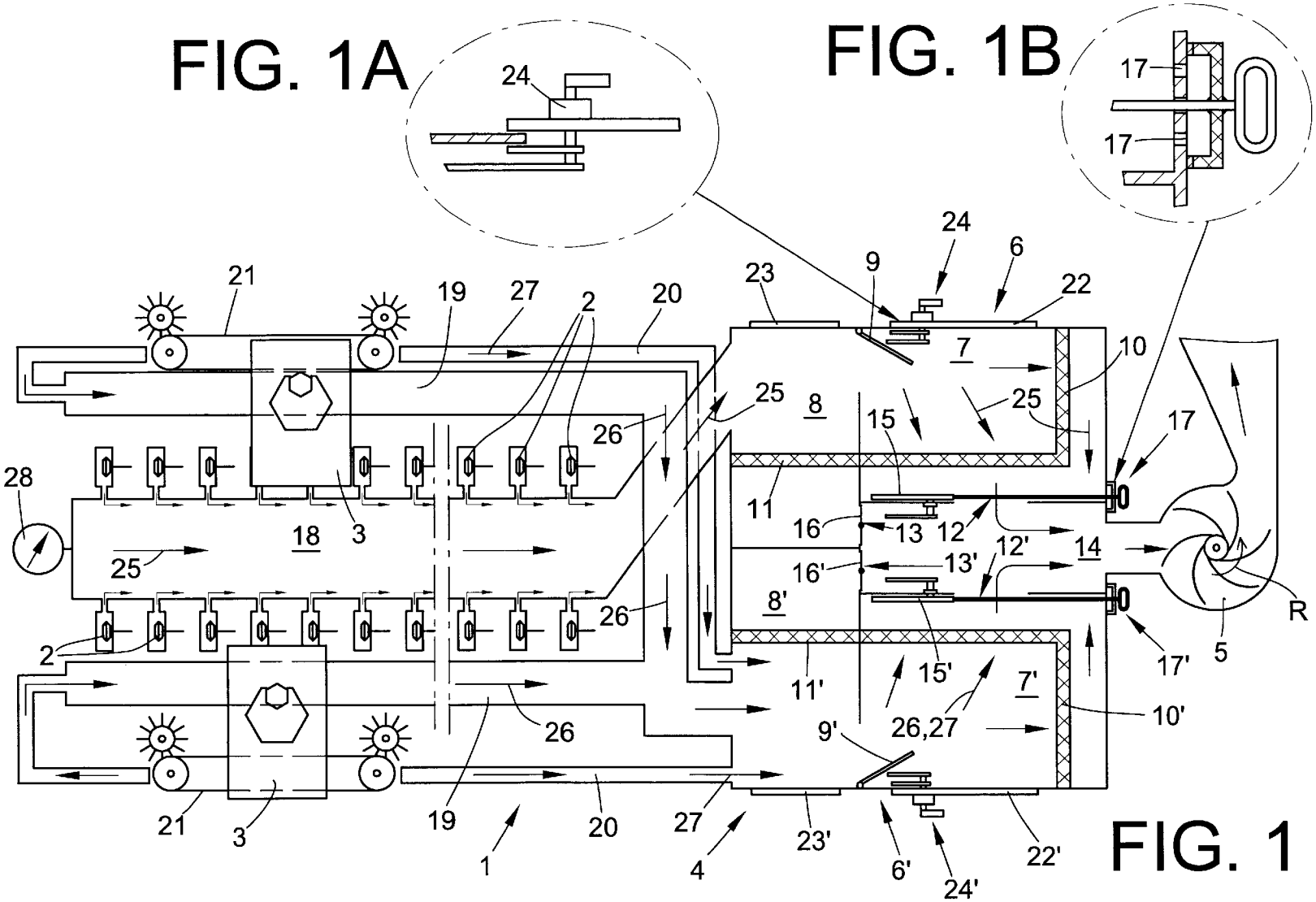
FIG. 1 is a schematic plan view of the negative pressure system of an open-end rotary spinning machine in accordance with the present invention, shown in a condition operative to direct the flow of the negative air for normal spinning operation.
FIG. 1A is an enlarged plan view of the closing mechanism between the main and reserve filter chambers of the negative pressure system of FIG. 1.
FIG. 1B is a enlarged plan view of the pressure equalization openings associated with the main filter chamber of the negative pressure system of FIG. 1.
Figure 2:
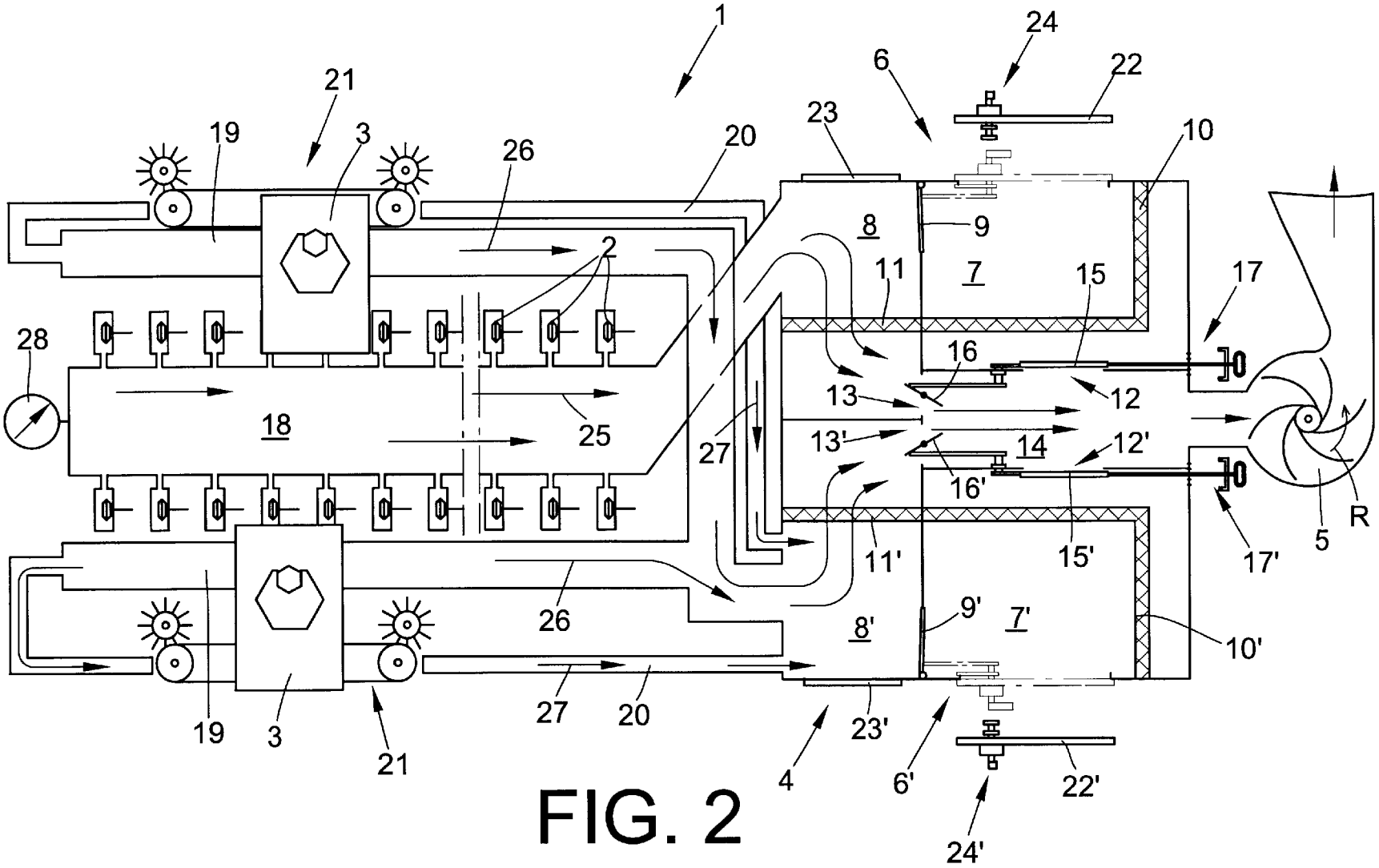
FIG. 2 shows the negative pressure system of FIG. 1, shown in a condition operative to direct the flow of the negative air for cleaning of the main filter chambers.

As indicated, FIGS. 1 and 2 show a negative pressure system of an open-end spinning machine, identified by reference numeral 1, in accordance with the present invention. Such spinning machines have many pneumatically operated devices and systems, such as open-end spinning devices 2, service units 3, vacuuming devices 20, etc. and, accordingly, such machines each have their own suction system with a filter device 4 for cleaning the air involved in the suction. The filter device 4, which is typically integrated into one of the end frames of the open-end spinning machine 1, has a negative pressure source 5. The filter device 4 also has two filter chambers 6, 6', disposed for instance symmetrically in mirror-image relation, with each of the filter chambers 6, 6' being divided into a main filter chamber 7 and 7' and a reserve filter chamber 8 and 8', respectively. Each main filter chamber 7, 7' can be partitioned off from its associated reserve filter chamber 8, 8' by a respective closing mechanism 9 and 9', preferably in the form of a pivotably disposed closure flap. One L-shaped filter element 10, 10' is disposed inside each of the main filter chambers 7, 7'. The reserve filter chambers 8, 8' each have a respective filter element 11, 11' as well.

The main filter chambers 7, 7' and the reserve filter chambers 8, 8' communicate via respective closable suction openings 12, 12' and 13, 13' with an intermediate chamber 14 disposed between the filter chambers 6,6', which intermediate chamber is connected to the negative pressure source 5.

Closure elements 15, 15' are respectively disposed in association with the suction openings 12, 12' and similarly closure elements 16, 16' are respectively disposed in association with the suction openings 13, 13', by means of which the respective suction openings 12, 12' and 13, 13' can be closed as needed. The closure elements 15, 16 and 15', 16' are functionally connected to operate in alternation with each other, i.e., such that, when the closure elements 15, 15' are moved to a position closing the suction openings 12, 12', the closure elements 16, 16' automatically open their associated suction openings 13, 13', and vice versa.

In the region of the main filter chambers 7, 7', pressure equalization openings 17, 17' are also provided, which are preferably automatically opened upon closure of the suction openings 12, 12'. See FIG. 1B.

As also indicated in the drawings, the filter chamber 6, which is disposed for instance in the end frame on one side of the machine, communicates with a suction conduit 18 extending centrally along the full length of the machine. In turn, the numerous open-end spinning devices 2 of the open-end spinning machine 1 are connected to the suction conduit 18 via branch lines.

The filter chamber 6' on the other side of the machine communicates with each of two transverse suction ducts 19 and with vacuuming devices 20 for the dirt conveyor belts 21. These dirt conveyor belts are disposed below the open-end spinning devices and are known, e.g., as described quite extensively in German Patent Disclosure DE 198 27 610.9, whereby such belts are not described herein in further detail.

The main filter chambers 7, 7' and the reserve filter chambers 8, 8' are accessible via cleaning doors 22, 22' and 23, 23', respectively. Each of the cleaning doors 22, 22' for the main filter chambers 7, 7' has a closing mechanism 24, 24' which is connected with the pivotable flap of the respectively associated closing mechanism 9, 9' such that, when one of the cleaning doors 22, 22' is opened, the flap of the associated closing mechanism 9, 9' between the main and reserve filter chambers is automatically closed.

The operating condition of the filter device 4 during regular spinning operation is shown in FIG. 1. As shown, the suction fan of the negative pressure source 5 revolves in the direction R to generate a negative pressure in the region of the intermediate chamber 14 that acts via the opened suction openings 12, 12' first on the main filter chambers 7, 7' of the filter chambers 6, 6', and then, because the closing mechanism 9, 9' are also opened, acts on the reserve filter chambers 8, 8' as well. As shown, during such operation, the suction openings 13, 13' between the reserve filter chambers 8, 8' and the intermediate chamber 14 are closed.

Thus, in the region of the suction conduit 18 connected to the filter chamber 6, a flow of suction 25 is established, which passes through the reserve filter chamber 8 to the main filter chamber 7, wherein the suction air flow 25 is cleaned at the L-shaped filter element 10.

The negative pressure prevailing in the intermediate chamber 14 also acts, via the filter chamber 6', to impose a suction air flow 26 through the transverse suction ducts 19 and a suction air flow 27 through the vacuuming devices 20. The suction flows 26, 27 are also cleaned at an L-shaped filter element 10' within the main filter chamber 7'.

A sensor arrangement 28 is provided in the end region of the suction conduit 18 for detecting the prevailing negative pressure within the suction conduit 18. If the sensor arrangement 28 detects that the negative pressure within the suction conduit 18 drops to a critical value for the spinning devices 2, then the filter screens 10, 10' of the main filter chambers 7, 7' require cleaning. Typically, such a pressure drop and a required cleaning of the filter screens 10, 10' will not be required until after a relatively long period of operation of the filter device 4.

Such a cleaning operation can be done either automatically, for instance by connecting the main filter chambers briefly to a central vacuuming system of the spinning mill, or manually. In either case, the suction openings 12, 12' of the main filter chambers 7, 7' are first closed by the closure elements 15, 15', as indicated in FIG. 2.

Upon closure of the suction openings 12, 12', the pressure equalization openings 17, 17' in the region of the main filter chambers 7, 7' are automatically uncovered, so that a pressure equalization takes place in the main filter chamber 7, 7'. Closure of the suction openings 12, 12' also triggers the closure elements 16, 16' to open the suction openings 13, 13' between the reserve filter chamber 8, 8' and the intermediate chamber 14.

Thereupon, negative pressure no longer prevails in the region of the main filter chambers 7, 7'. Accordingly, upon unlocking of the cleaning doors 22, 22', the closing mechanism 9, 9' disposed between the main and reserve filter chamber is automatically moved into a closing position via the closing mechanism 24, 24'. See also FIG. 1A. The cleaning doors 22, 22' may be opened without problems to perform manual cleaning, and the dirt and fiber material adhering to the L-shaped screen element 10, 10' can be removed.

As indicated in FIG. 2, during the cleaning of the main filter chambers 7, 7', the suction air flows 25, 26, 27 pass through the filter screens 11, 11' of the reserve filter chambers 8, 8'. Thus, the continued supply of suction to the textile machine is completely assured even in the cleaning phase, so that the operation of the open-end spinning machine 1 can be continued uninterrupted without any restriction whatever even during the cleaning of the filter screens of the main filter chambers.

It is to be understood that the above description applies logically whether only one or both of the filter elements 10 or 10', disposed in either or both of the main filter chambers 8 or 8', is being cleaned, and whether the cleaning of the filter screens is performed manually or automatically.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A filter device for a suction system of a cheese-producing textile machine comprising at least one filter chamber divided into a main filter sub-chamber and a reserve filter sub-chamber, an intermediate chamber connected to the filter chamber, a negative pressure source connected to the intermediate chamber, a closure mechanism associated with the intermediate chamber for selectively communicating the negative pressure source with the filter chamber, the closure mechanism including suction openings for communicating the intermediate chamber with the main filter sub-chamber and the reserve filter sub-chamber and closure elements respectively associated with the suction openings and functionally coupled with one another for closing and opening the suction openings alternately for communicating the intermediate chamber concurrently with the main filter sub-chamber and the reserve filter sub-chamber or for communicating the intermediate chamber only with the reserve filter sub-chamber, wherein the main filter sub-chamber includes a pressure equalization opening and the closure mechanism is arranged for closing the pressure equalization opening during a normal operating mode and for automatically opening the pressure equalization opening upon closure of the suction opening of the main filter sub-chamber.

2. A filter device for a suction system of a cheese-producing textile machine comprising at least one filter chamber divided into a main filter sub-chamber and a reserve filter sub-chamber, an intermediate chamber connected to the filter chamber, a negative pressure source connected to the intermediate chamber, a closure mechanism associated with the intermediate chamber for selectively communicating the negative pressure source with the filter chamber, the closure mechanism including suction openings for communicating the intermediate chamber with the main filter sub-chamber and the reserve filter sub-chamber and closure elements respectively associated with the suction openings and functionally coupled with one another for closing and opening the suction openings alternately for communicating the intermediate chamber concurrently with the main filter sub-chamber and the reserve filter sub-chamber or for communicating the intermediate chamber only with the reserve filter sub-chamber, wherein the at least one filter chamber comprises two filter chambers at least one of which is divided into the main and reserve filter sub-chambers.

3. The filter device of claim 2, wherein the two filter chambers are substantially identical.

4. The filter device of claim 2, wherein one of the filter chambers communicates with a plurality of pneumatic devices via a suction conduit.

5. The filter device of claim 4, wherein the one filter chamber communicates with a plurality of open-end spinning devices.

6. The filter device of claim 3, wherein one of the filter chambers communicates with at least one service unit via a suction duct and with dirt disposal devices via a vacuuming device.

7. The filter device of claim 2, wherein the intermediate chamber is disposed between the two filter chambers.

8. A filter device for a suction system of a cheese-producing textile machine comprising at least one filter chamber divided into a main filter sub-chamber and a reserve filter sub-chamber, a first closure mechanism between the main and reserve filter sub-chambers for selectively opening and closing communication therebetween, an intermediate chamber connected to each of the main and reserve filter sub-chambers of the filter chamber, a second closure mechanism between the intermediate chamber and the main filter sub-chamber for selectively opening and closing communication therebetween, a third closure mechanism between the intermediate chamber and the reserve filter sub-chamber for selectively opening and closing communication therebetween, and a negative pressure source connected to the intermediate chamber, the first, second, and third closure mechanisms being operatively associated with one another for shifting alternately between a first operating phase wherein the first and second closure mechanisms are open and the third closure mechanism is closed for communicating the intermediate chamber concurrently with each of the main and reserve filter sub-chambers, and a second operating phase wherein the first and second closure mechanisms are closed and the third closure mechanism is open for communicating the intermediate chamber only with the reserve filter sub-chamber.

9. The filter device of claim 8, wherein the second and third mechanisms are mechanically connected to each other.

10. The filter device of claim 8, wherein the main filter sub-chamber includes a cleaning door openable outside the main filter sub-chamber for cleaning.

11. The filter device of claim 10, wherein the first closure mechanism includes a closure disposed between the main filter sub-chamber and the reserve filter sub-chamber and the cleaning door includes a mechanism connected with the closure for closing the closure when the cleaning door is opened.

12. A filter device for a suction system of a cheese-producing textile machine comprising at least one filter chamber divided into a main filter sub-chamber and a reserve filter sub-chamber, an intermediate chamber connected to the filter chamber, a negative pressure source connected to the intermediate chamber, a closure mechanism associated with the intermediate chamber for selectively communicating the negative pressure source with the filter chamber, the closure mechanism including suction openings for communicating the intermediate chamber with the main filter sub-chamber and the reserve filter sub-chamber and closure elements respectively associated with the suction openings and functionally coupled with one another for closing and opening the suction openings alternately for communicating the intermediate chamber concurrently with the main filter sub-chamber and the reserve filter sub-chamber or for communicating the intermediate chamber only with the reserve filter sub-chamber, the main filter sub-chamber and the reserve filter sub-chamber each comprising a filter screen, the area of the filter screen of the reserve filter sub-chamber being smaller than the area of the filter screen of the main filter sub-chamber.

13. The filter device of claim 12, wherein the area of the filter screen of the reserve filter sub-chamber is less than half of the area of the filter screen of the main filter sub-chamber.

* * * * *